US007228598B1

(12) United States Patent
Powers

(10) Patent No.: US 7,228,598 B1
(45) Date of Patent: Jun. 12, 2007

(54) BUTTON SOUND SAVER

(76) Inventor: Scott A. Powers, 221 Larpenteur Ave., Roseville, MN (US) 55113

( * ) Notice: Subject to any disclaimer, the term of this patent is extended or adjusted under 35 U.S.C. 154(b) by 91 days.

(21) Appl. No.: 11/223,307

(22) Filed: Sep. 9, 2005

(51) Int. Cl.
*A44B 1/10* (2006.01)

(52) U.S. Cl. ..... 24/113 R; 24/DIG. 29

(58) Field of Classification Search ..... 24/90.5, 24/114, DIG. 29, 113 R, 113 MP
See application file for complete search history.

(56) References Cited

U.S. PATENT DOCUMENTS 3,757,388 A 9/1973 Wolny
4,539,731 A 9/1985 Torrini
5,161,285 A 11/1992 Jerjian
5,621,951 A 4/1997 Gould
D396,202 S 7/1998 Lindsay
5,901,417 A 5/1999 Alexiou
2004/0034971 A1 * 2/2004 Bagot ..... 24/113 R
2004/0226145 A1 11/2004 Ouellette et al.

FOREIGN PATENT DOCUMENTS

DE 29721230 U1 * 5/1998
WO WO 9605749 A1 * 2/1996

* cited by examiner

*Primary Examiner*—James R. Brittain
(74) *Attorney, Agent, or Firm*—Lawrence J. Gibney, Jr.

(57) ABSTRACT

This device will muffle the sound of buttons while clothes are being washed or dried. Because of the exposure to extremes in temperature as well as agitation it should be constructed of durable non-corrosive material.

4 Claims, 5 Drawing Sheets

BUTTON SOUND SAVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to muffling the sound of a button particularly in a washer or dryer.

B. Prior Art

There are many other items related to washing and drying accessories and in particular related to clothing. An example of this is a button protector patented by Alexiou U.S. Pat. No. 5,901,417. The difference between the Alexiou patent and the current patent are the means to cover the device as well as to release the device.

Another example of the respresentive prior art includes Ouellette US publication 2004/0226145. This again is a button cover which has similar structure but does not have the release mechanism found in the current application.

BRIEF SUMMARY OF THE INVENTION

This is a device to muffle the sound of buttons on clothing while in the washer or dryer. This device can be used on any type of clothing with buttons including pants, shirts, blouses and dresses to name just a few examples.

The device will have a casing which is likely to be plastic. The casing will have a quick release mechanism as well as a slot to slip over the button. Enough space will be provided to insure that the casing slips over the button.

Additionally, padded material around the casing is provided to muffle the sound and protect the button.

A mechanism to release the device is placed on the exterior to quickly remove the device from the button.

It is an object of this device to make a device to muffle the sound of a button in a washer or dryer.

It is a further object of this device to make a device to protect a button during washing and drying.

DETAILED DESCRIPTION OF THE EMBODIMENT

Figure 1:
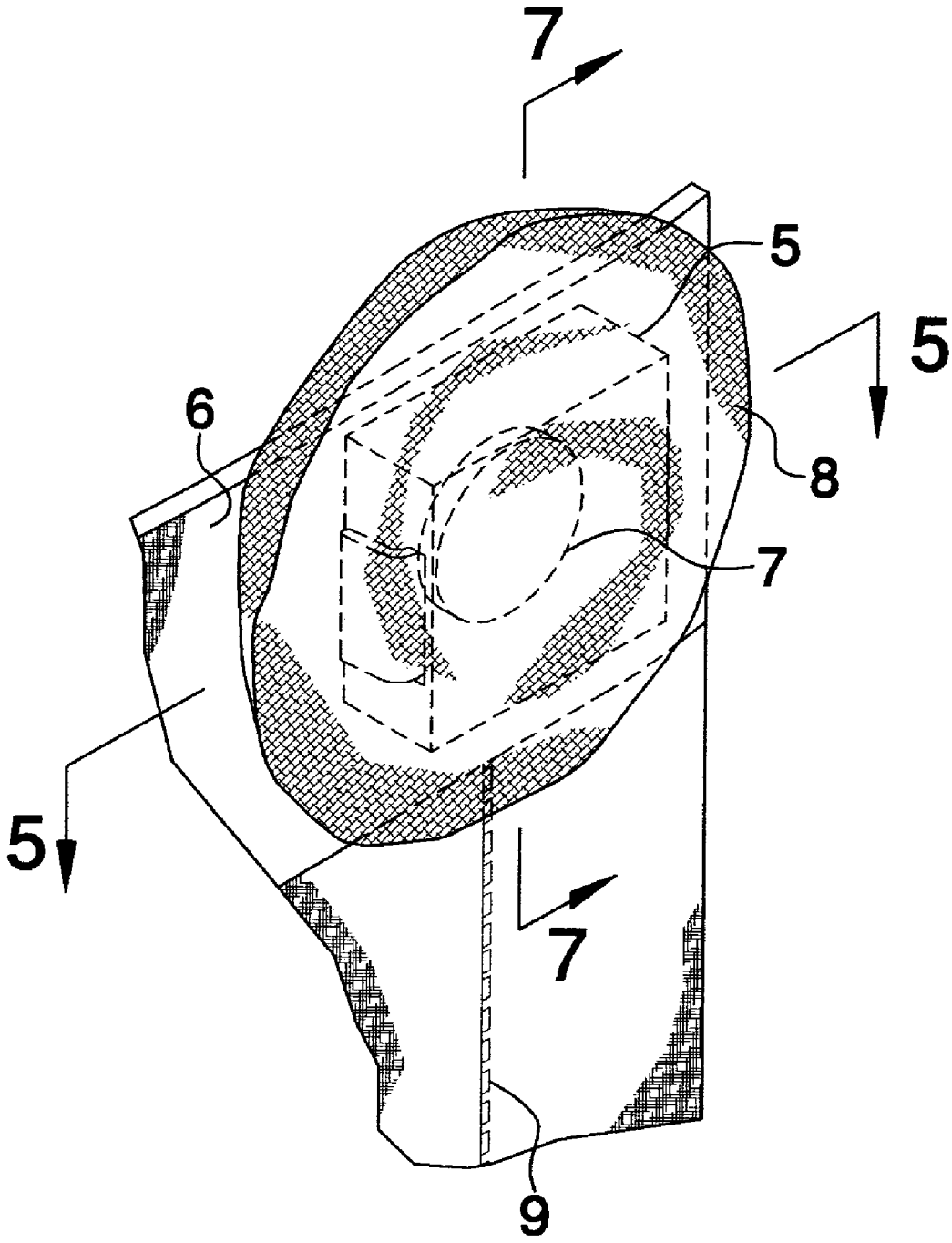
FIG. 1 is a isometric view of the device with the dashed lines indicating the button as well as the device over a button.
Figure 2:
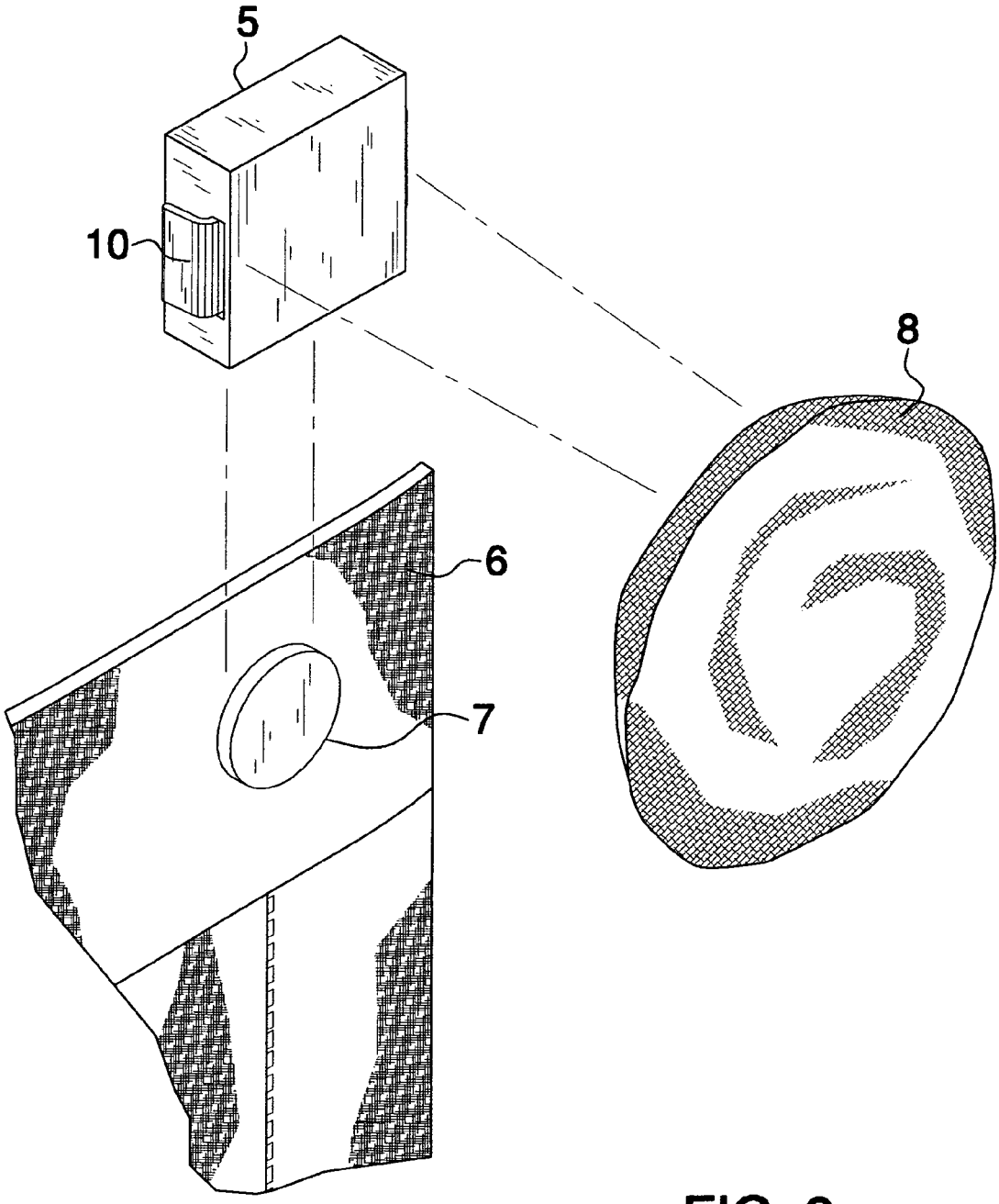
FIG. 2 is an exploded view of the use of the manner in which the button device is used.
Figure 3:
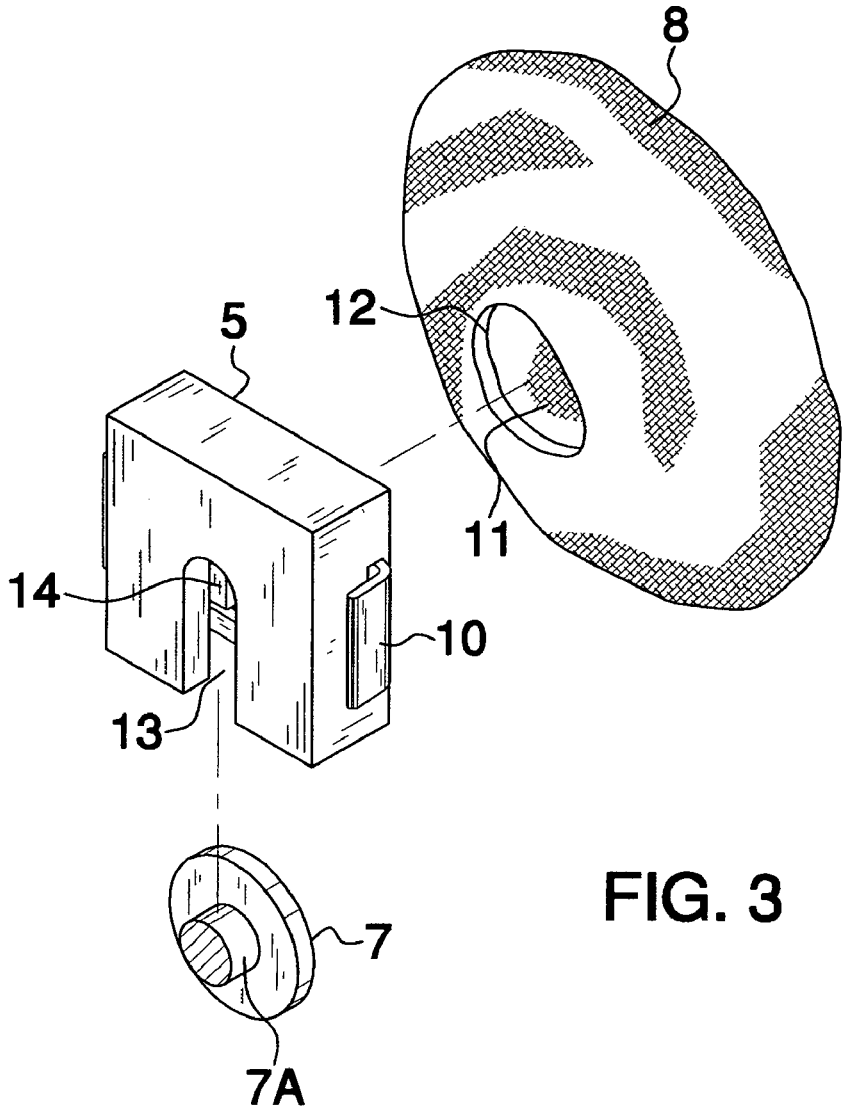
FIG. 3 is a exploded view of the device without the pants.
Figure 5:
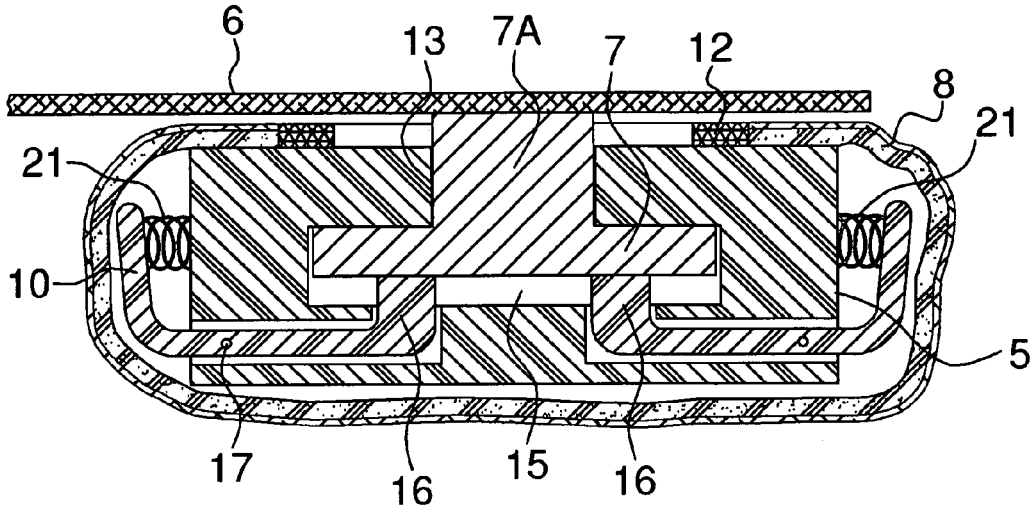
FIG. 5 is a cross sectional view according to line 5-5 on FIG. 1.

This device will cover the button 7 on a piece of clothing such as jeans 6. FIGS. 1, 2 The button 7 on the jeans 6 will be completely covered by the device and the casing 5 will be wrapped by a padded material 8 to muffle the sound. The padded material 8 may be denim or cotton. The padded material will be elastic with an opening 11 and an elastic band to cover the casing 5. FIGS. 1, 3 This elasticity and the opening will allow the padded material to easily slip over and cover the casing 5. FIGS. 3, 5

Figure 4:
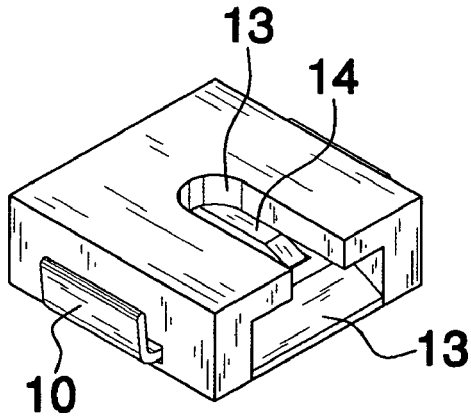
FIG. 4 is an isometric of the casing.
Figure 6:
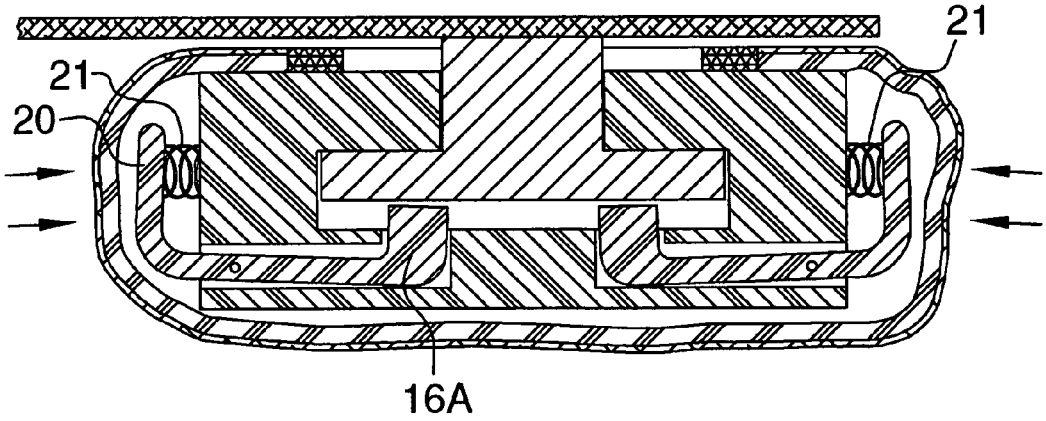
FIG. 6 is a cross sectional view according to line 5-5 on FIG. 1 demonstrating the operation of the button release.
Figure 7:
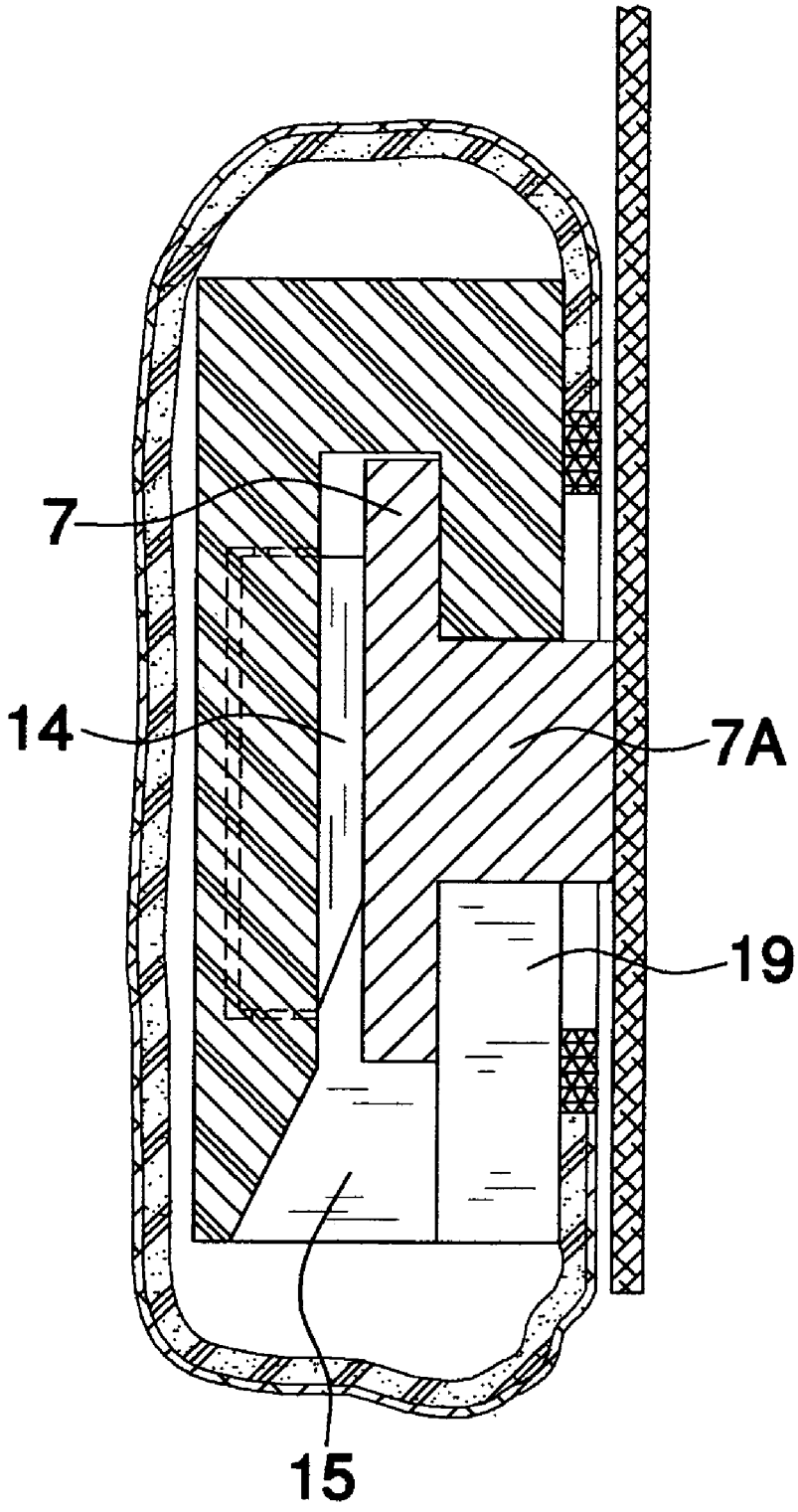
FIG. 7 is a cross sectional view according to line 7-7 on FIG. 1.

The casing, which is likely plastic, has a slot 13 which will slide over the clothes button 7 so that the button stem 7*a* will remain connected to the pants 6 but allow the button to be covered by the casing 5. FIGS. 1, 3 In the interior of the casing will be a brake mechanism 14, which will secure the casing 5 to the button 7 and button stem 7*a*. FIGS. 4, 7 The brake mechanism 14 will be comprised of two identically shaped members with a flat surface 16 on one end, a pivot means 17 in the approximate middle and the release mechanism surface 20 on the other end. A spring 21 is provided on the inside surface of the release mechanism surface to provide tension. A pin, which secures the brake mechanism 14, will probably be a suitable pivot point 17 and provide a means to attach the brake mechanism to the casing 5. FIGS. 5, 6, 7

One of the flat surfaces 16 for each of the brake mechanisms will contact the button 7; a sufficient amount of tension is provided by the spring 21 to secure the casing 5 to the button 7 during washing and drying.

On both sides of the device will be a release mechanism 10 to release the device from the button 7. This will likely be a mechanism, which is squeezed to release the device. FIGS. 5, 6

FIGS. 5 and 6 show the device securing the button 7. The release mechanism 10 is connected on either side to a pivot point 17, which will allow the flat surface 16 to move away from the surface of the button when the release mechanism 10 is pressed inward as depicted in FIG. 6. On one end of the release mechanism 10 is a flat surface 16, which contacts the button on the interior of the device. A means to provide appropriate tension to secure the button 7 is provided and a spring 21 is probably an appropriate choice.

When the device is installed over the button the respective flat surfaces 16 will contact the button 7 surface and tension created by the springs 21 will keep the casing secured to the button. The padded material 8 will surround the casing. The slot is sized so that when the casing 5 is inserted over the button 7 a cavity 15 will be created between the two respective flat surfaces 16. FIGS. 5, 7 Additionally the sides of the slot 13 will be constructed so that the sides of the slot fit over the button and keep the casing secured to the button during the washing and drying process.

To remove the item the sides of the release mechanism 10 are squeezed and the respective flat surfaces 16 no longer remain in contact with the surface of the button 7. As the release mechanism surface 20 is squeezed inward the flat surface 16 will no longer contact the button as it rotates around the pivot point. The device can then be removed from the button 7.

The invention claimed is:

1. A device to eliminate and reduce sound on a button during washing and drying which is comprised of:

a. casing;

wherein the casing is of predetermined size;

wherein the casing has a slot;

wherein the slot is larger than the button on the clothing;

b. padded material;

wherein an opening is provided in the padded material;

wherein the padded material opening is inserted over the casing;

wherein the padded material is provided with an elastic strap around the perimeter of the opening;

c. a brake mechanism and a second brake mechanism are provided;

wherein each brake mechanism has a first end and a second end;

said first ends of the brake mechanisms contact the surface of the button;

wherein the first ends of the brake mechanisms secure the casing to the button;

said second ends of the brake mechanisms are release mechanisms;

wherein a means for connecting the brake mechanisms to the casing is provided;

wherein said release mechanisms are provided on both sides of the exterior of the casing; and wherein a means for providing tension to the release mechanisms is provided.

2. The device of claim 1 wherein the padded material is denim.

3. The device of claim 1 wherein the padded material is cotton.

4. The device of claim 1 wherein the means to provide tension for the release mechanism is a plurality of springs.

* * * * *